US005712648A

United States Patent [19]

Tsujiguchi

[11] Patent Number: 5,712,648

[45] Date of Patent: Jan. 27, 1998

[54] DIELECTRIC FILTER AND ANTENNA DUPLEXER

[75] Inventor: Tatsuya Tsujiguchi, Kanazawa, Japan

[73] Assignee: Murata Manufacturing Co., Ltd., Japan

[21] Appl. No.: 655,412

[22] Filed: May 30, 1996

[30] Foreign Application Priority Data

May 31, 1995 [JP] Japan ..... 7-134058

[51] Int. Cl.[6] ..... H01Q 15/02

[52] U.S. Cl. ..... 343/909; 343/756; 343/873; 333/134

[58] Field of Search ..... 343/700 MS, 702, 343/756, 873, 909; 333/134, 202

[56] References Cited

U.S. PATENT DOCUMENTS

| | | | |
|---|---|---|---|
| 3,155,975 | 11/1964 | Chatelain | 343/873 |
| 5,471,180 | 11/1995 | Bromer et al. | 343/909 X |
| 5,541,616 | 7/1996 | Kawahata et al. | 343/702 X |
| 5,578,975 | 11/1996 | Kazama et al. | 333/134 X |

*Primary Examiner*—Donald T. Hajec
*Assistant Examiner*—Tho Phan
*Attorney, Agent, or Firm*—Ostrolenk, Faber, Gerb & Soffen

[57] ABSTRACT

A dielectric filter includes a dielectric block on which an external conductor is formed except for areas surrounding input and output terminals, a plurality of resonator holes of the same axial length, and input and output external coupling bores. The resonator holes and input and output external coupling bores are formed substantially in parallel with each other between a pair of opposing end faces of the dielectric block. The resonator holes are provided with internal conductors except for dielectric bases in the vicinity of openings thereof. The internal conductors are connected to the external conductor at the pair of end faces so that resonators having specific resonator lengths are constituted by the positions of open ends thereof formed by the dielectric bases. The input and output external coupling bores are provided with internal conductors. The internal conductors are connected to the external conductor at one end face of the dielectric block and connected to the input and output terminals at the other end face of the dielectric block. Corresponding features are provided in an antenna duplexer.

4 Claims, 6 Drawing Sheets

DIELECTRIC FILTER AND ANTENNA DUPLEXER

BACKGROUND OF THE INVENTION

1. Field of the Invention

The present invention relates to a dielectric filter and an antenna duplexer in which a plurality of resonators composed of holes of the same axial length are formed in one dielectric block.

2. Description of the Related Art

FIG. 8 illustrates a conventional dielectric filter in which a plurality of resonators 31, 32 and 33 of different frequencies are formed in a dielectric block 30. In such a conventional dielectric filter, since the frequencies are different, the lengths of the corresponding resonators are naturally different so that the outer shape of the dielectric filter 30 is complicated. A similar situation may also apply to an antenna duplexer in which a plurality of transmitting resonators and receiving resonators of different frequency bands are integrally formed in one dielectric block.

In such a conventional dielectric filter and antenna duplexer in which resonators are integrally formed in one dielectric block, the resonators should be formed in the dielectric filter with lengths that vary according to frequency, or wavelength. Thus, the shape of the dielectric filter is complicated even if the dielectric filter is formed by a die in one operation.

Further, the die cannot be used for forming another dielectric filter of slightly different frequency, so a new die must be prepared each time a resonator of different frequency is formed, so that the conventional dielectric filter and antenna duplexer are expensive.

SUMMARY OF THE INVENTION

It is an object of the present invention to provide a dielectric filter and an antenna duplexer in which a plurality of resonators of different resonant frequencies, or resonant wavelengths, are formed in one dielectric block by resonator holes of the same axial length so that the actual lengths of the resonators are determined or adjusted by the positions of the dielectric bases formed in the resonator holes.

A "dielectric base" is defined to refer to a portion of the dielectric block that is not covered with a conductor so that the dielectric material at that portion is exposed.

In one aspect of the present invention, there is provided a dielectric filter which comprises a dielectric block on which an external conductor is mainly formed except for areas surrounding input and output terminals; a plurality of resonator holes of the same axial length; input and output external coupling bores, the resonator holes and input and output external coupling bores being formed substantially in parallel with each other between a pair of opposing end faces of the dielectric block; the resonator holes having internal conductors except for dielectric bases in the vicinity of openings thereof, and the internal conductors being connected to the external conductor at both of the pair of end faces so that resonators having specific resonator lengths are constituted by the positions of open ends formed by the dielectric bases; and the input and output external coupling bores having internal conductors, the internal conductors being connected to the external conductor at one end face of the dielectric block and being connected to the input and output terminals at the other end face of the dielectric block.

In another aspect of the present invention, there is provided an antenna duplexer which comprises a dielectric block on which an external conductor is mainly formed except for areas surrounding input and output terminals and an antenna terminal; a plurality of transmitting and receiving resonator holes of the same axial length; input and output external coupling bores; an antenna external coupling bore, the resonator holes, input and output external coupling bores and antenna external coupling bore being formed substantially in parallel with one another between a pair of opposing end faces of the dielectric block, the input and output external coupling bores being disposed at the outside of the transmitting and receiving resonator holes, respectively, and the antenna external coupling bore being disposed between the transmitting and receiving resonator holes; the transmitting and receiving resonator holes having internal conductors except for dielectric bases in the vicinity of openings thereof, and the internal conductors being connected to the external conductor at both of the pair of end faces so that resonators having specific resonator lengths are constituted by the positions of open ends formed by the dielectric bases; and the input and output external coupling bores and antenna external coupling bore having internal conductors, the internal conductors being connected to the external conductor at one end face of the dielectric block, and being connected to the input and output terminals and to the antenna terminal at the other end face of the dielectric block.

The dielectric filter and antenna duplexer according to the aspects of the present invention described above may further have the following features.

In the dielectric filter and the antenna duplexer as described above, external coupling adjustment bores having internal conductors may be formed in the vicinity of, and in parallel with the input and output external coupling bores, respectively, between the pair of opposing end faces of the dielectric block.

In the antenna duplexer as described above, antenna external coupling adjustment bores having internal conductors may be formed in the vicinity of the outside of, and in parallel with the input and output external coupling bores, respectively, between the pair of opposing end faces of the dielectric block.

In each form of the dielectric filter and the antenna duplexer as described above, trap resonators may be formed in the vicinity of the outside of, and in parallel with the input and output external coupling bores between the pair of opposing end faces of the dielectric block.

In each form of the dielectric filter and the antenna duplexer as described above, the plurality of resonators may be composed of straight holes.

In each form of the dielectric filter and the antenna duplexer as described above, the plurality of resonators may have steps formed between large diameter resonator holes and small diameter resonator holes which are coaxial with each other.

In each form of the dielectric filter and the antenna duplexer as described above, the plurality of resonators may have steps formed between non-coaxial large diameter resonator holes and small diameter resonator holes.

In each form of the dielectric filter and the antenna duplexer as described above, the plurality of resonators may be composed of straight holes, or have steps formed between coaxial large diameter resonator holes and small diameter resonator holes, or have steps formed between non-coaxial large diameter resonator holes and small diameter resonator holes, alone or in combination.

In each form of the dielectric filter and the antenna duplexer as described above, at least one of the principal surfaces of the dielectric block may have a step formed in a direction substantially at right angles to the resonator holes.

In each form of the dielectric filter and the antenna duplexer as described above, at least one of the principal surfaces of the dielectric block may have slits formed between the resonator holes and extending in the same direction as that of the resonators.

In each form of the dielectric filter and the antenna duplexer as described above, coupling slots may be formed between and substantially in parallel with the resonator holes and extending from the open-circuit end of the dielectric block.

In each form of the dielectric filter and the antenna duplexer as described above, the plurality of resonators may be common-line-coupled with the open circuit ends thereof facing in the same direction.

In each form of the dielectric filter and the antenna duplexer as described above, the plurality of resonators may be interdigitally coupled with the open circuit ends thereof disposed alternately.

In each form of the antenna duplexer as described above, the antenna external coupling bore and the antenna external coupling adjustment bores may be formed independently in a transmitting filter and a receiving filter, respectively.

According to the advantageous features of the present invention, a plurality of resonators of different resonant frequencies (resonant wavelengths) are formed in one dielectric block by holes of the same axial length so that the actual lengths of the resonators are determined by the positions of the dielectric bases formed in the resonator holes. Therefore, the dielectric block in which the dielectric filter or antenna duplexer composed of a plurality of resonators of different frequencies is formed can be formed into a simple rectangular shape.

DESCRIPTION OF PREFERRED EMBODIMENTS

Several preferred embodiments of the present invention will now be described with reference to the accompanying drawings.

Figure 1:
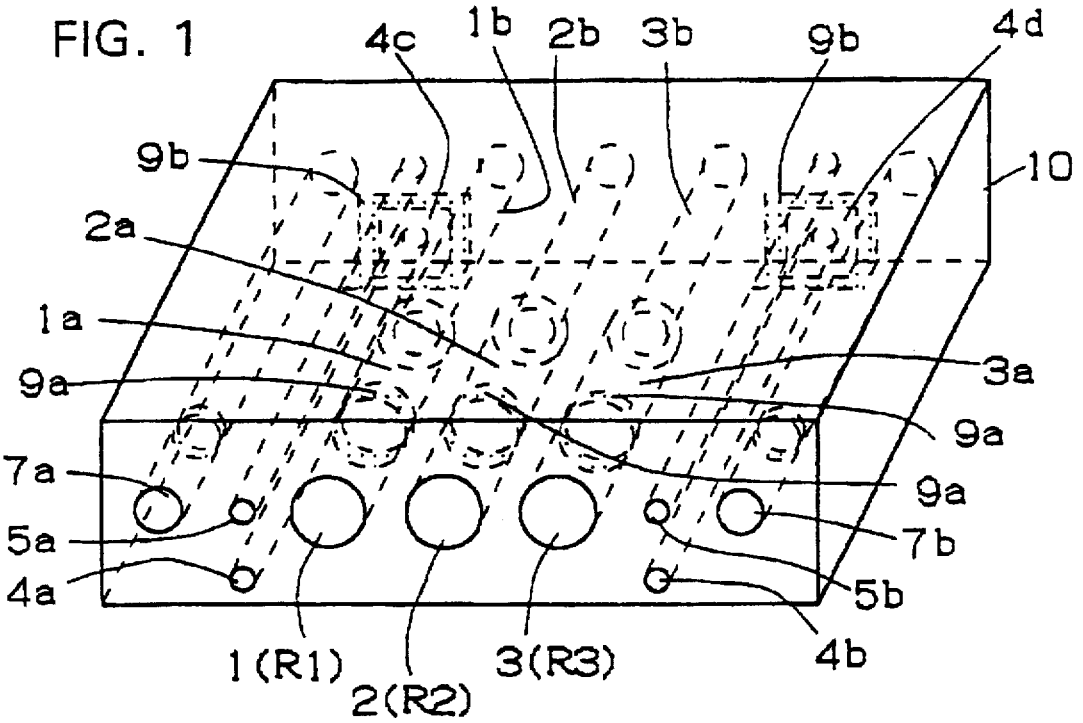
FIG. 1 is a perspective view showing a first embodiment of a dielectric filter according to the present invention.

FIG. 1 is a perspective view showing a first embodiment of a dielectric filter according to the present invention. Referring to FIG. 1, an outer surface of a rectangular dielectric block 10, except for dielectric bases 9b around the input and output terminals, which will be described later, is mainly coated with an external conductor. Resonators R1 to R3 are formed between a pair of opposing end faces of the dielectric block 10 by resonator holes 1 to 3 each having the same axial length and having an inner coating which forms an internal conductor. The resonator holes 1 to 3 are coaxially and stepwise formed into large diameter resonator holes 1a, 2a and 3a and small diameter resonator holes 1b, 2b and 3b, respectively.

In the vicinity of the openings of the large diameter resonator holes 1a to 3a at one end face (the open-circuit end face) of the dielectric block 10, open ends of the resonators are formed by ring-shaped dielectric bases 9a. The lengths of the resonators R1 to R3 are measured from the other end face (the short-circuit end face) to the dielectric bases 9a. Therefore, since resonant frequencies of the resonators R1 to R3 are formed by the lengths of the resonators, they are determined by the positions of the dielectric bases 9a.

Each of the resonators R1 to R3 is coupled by a common line to the one next to it. In the resonators R1 to R3, the large diameter resonator holes 1a to 3a are formed coaxially with respect to the small diameter resonator holes 1b to 3b, in the direction toward the open circuit end-face, in order to cause a capacitive coupling between the resonators adjacent to each other by reducing the impedance of the open-circuit ends of the resonators to be lower than that of the short-circuit ends. Thus, by forming the large resonator holes 1a to 3a, the coupling between the resonators can be controlled to be capacitive coupling.

In the vicinity of the resonator hole 1, an input external coupling bore 4a is formed in parallel with the resonator hole 1. An internal conductor of the external coupling bore 4a is connected to the external conductor at one end face of the dielectric block 10, in this case the open-circuit end face, and is connected to an input terminal 4c which is isolated from the external conductor by the dielectric base 9b at the other end face of the dielectric block 10. The external coupling bore 4a receives input signals and transmits them by electromagnetic coupling with the resonator R1.

In addition, in the vicinity of the resonator hole 3, an output external coupling bore 4b is formed in parallel with the resonator hole 3. An internal conductor of the external coupling bore 4b is, as in the case of the input external coupling bore 4a, connected to the external conductor at one end face of the dielectric block 10, in this case the open-circuit end face, and is connected to an output terminal 4d which is isolated from the external conductor by the dielectric base 9b at the other end face (here, the short-circuit end face) of the dielectric block 10. The external coupling bore 4b receives output signals by electromagnetic coupling with the resonator R3.

Further, in the vicinity of the input external coupling bore 4a and the resonator hole 1 (resonator R1), an external coupling adjustment bore 5a is formed in parallel with the input external coupling bore 4a and the resonator hole 1. The external coupling adjustment bore 5a is provided with an internal conductor. The external coupling adjustment bore 5a has the function of adjusting the electromagnetic coupling between the input external coupling bore 4a and the resonator R1.

Still further, in the vicinity of the output external coupling bore 4b and the resonator hole 3 (resonator R3), an external coupling adjustment bore 5b is formed in parallel with the output external coupling bore 4b and the resonator hole 3. The external coupling adjustment bore 5b is provided with an internal conductor. The external coupling adjustment bore 5b has the function of adjusting the electromagnetic coupling between the output external coupling bore 4b and the resonator R3.

The dielectric filter of this embodiment can be constructed as described above. However, in some instances, trap resonators 7a and 7b containing straight resonator holes may additionally be provided outside and in the vicinity of the input external coupling bore 4a and the output external coupling bore 4b to improve filtering characteristics.

In this embodiment, the resonators R1 to R3 having different resonant frequencies, or wavelengths, are formed in the dielectric block 10 in such a manner that the axial lengths of the resonator holes thereof are equal. The actual length of the resonators is determined by the position of the dielectric base 9a formed in the resonator holes.

According to the above-described embodiment, a stray capacitance Cs is generated between the two ends of the dielectric bases 9a forming the open ends of the resonators. The stray capacitance Cs has the action and function of disturbing the balance of the electromagnetic field distribution to cause inductive common-line coupling between the resonators adjacent to each other and to enable the dielectric resonators to act as filters.

Figure 2:
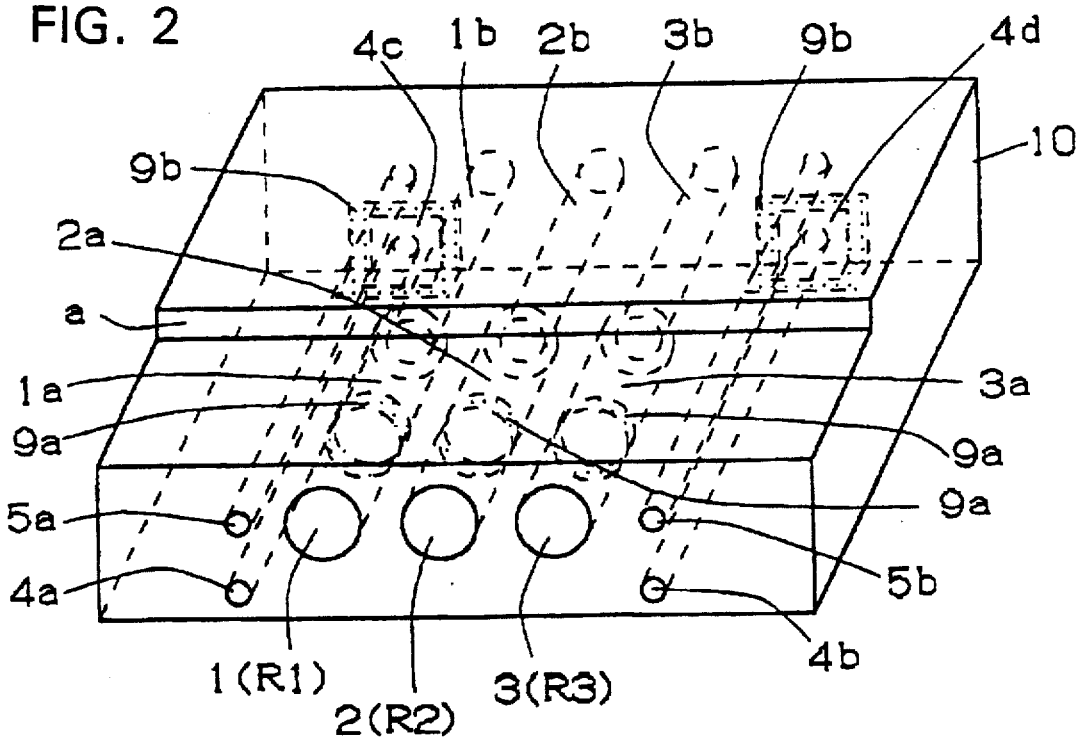
FIG. 2 is a perspective view showing a second embodiment of a dielectric filter according to the present invention.
Figure 3:
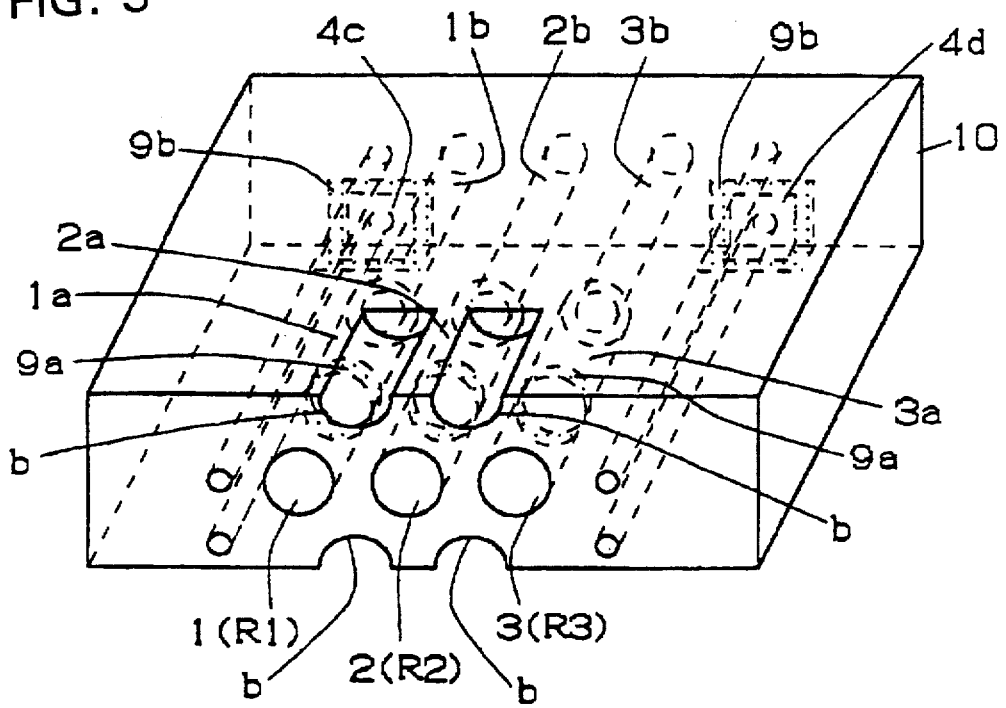
FIG. 3 is a perspective view showing a third embodiment of a dielectric filter according to the present invention.
Figure 4:
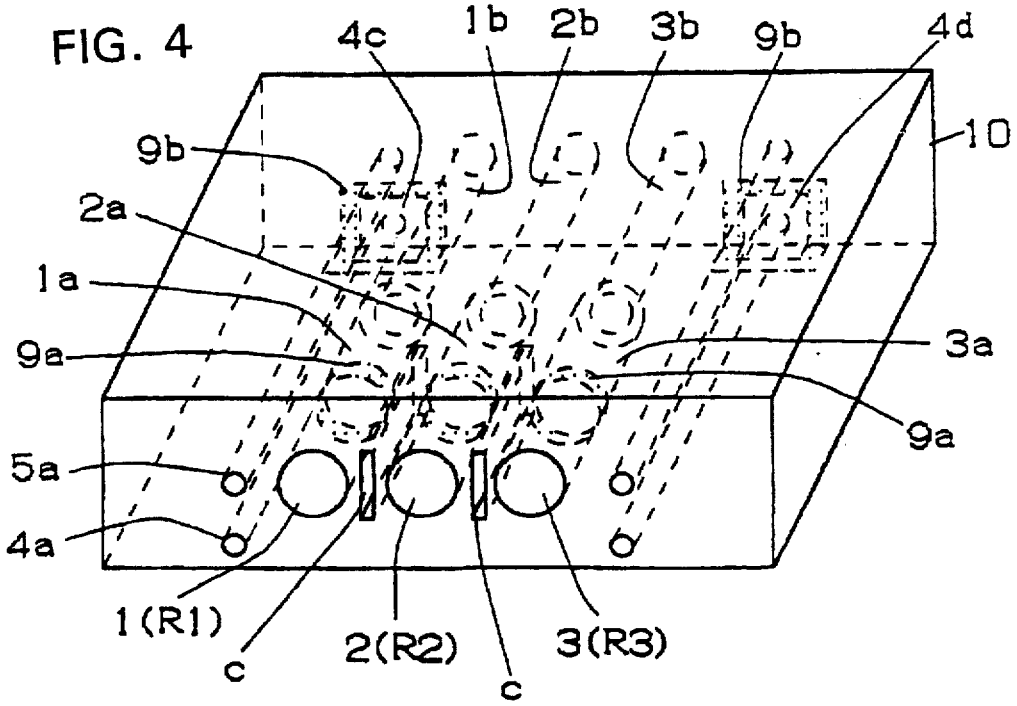
FIG. 4 is a perspective view showing a fourth embodiment of a dielectric filter according to the present invention.

In addition to the above-described structures, other structures for causing inductive coupling within the block among the dielectric resonators and activating the resonators to function as filters are, for example, shown in FIGS. 2 to 4.

In a second embodiment of the dielectric filter according to the present invention shown in FIG. 2, part of a principal surface of the dielectric block 10 adjacent the open-circuit end is cut away to form a step a which is coated by the external conductor. The inductive common-line coupling among the resonators can be increased by forming the step a at the open-circuit end as described above. Referring to FIG. 2, since the structure of the dielectric filter 10 is similar to that shown in FIG. 1, except for the step a, the same components are indicated by the same reference numerals and an explanation thereof has been omitted. In this embodiment, the trap resonators 7a and 7b shown in FIG. 1 (not shown in FIG. 2) may be also provided to improve filtering characteristics.

In a third embodiment of the dielectric filter according to the present invention shown in FIG. 3, semicylindrical-shaped slits b are formed between the resonators R1 and R2, and between the resonators R2 and R3, at the open-circuit end of both principal surfaces of the dielectric block 10. As in the case of FIG. 2, the inductive common-line coupling among the resonators can be increased by forming the slits b at the open-circuit end. Referring to FIG. 3, since the structure of the dielectric filter 10 is similar to that shown in FIG. 1, except for the slits b, the same components are indicated by the same reference numerals and an explanation thereof has been omitted. In this embodiment, the trap resonators 7a and 7b shown in FIG. 1 (not shown in FIG. 3) may be also provided to improve filtering characteristics.

In a fourth embodiment of the dielectric filter according to the present invention shown in FIG. 4, coupling slots c are formed between the resonators R1 and R2, and between the resonators R2 and R3, at the open-circuit end of the dielectric block 10. As in the case of FIGS. 2 and 3, the inductive common-line coupling among the resonators can be increased by forming the coupling slots c at the open-circuit side. Referring to FIG. 4, since the structure of the dielectric filter 10 is similar to that shown in FIG. 1, except for the coupling slots c, the same components are indicated by the same reference numerals and an explanation thereof has been omitted. In this embodiment, the trap resonators 7a and 7b shown in FIG. 1 (not shown in FIG. 4) may be also provided to improve filtering characteristics.

Figure 5:
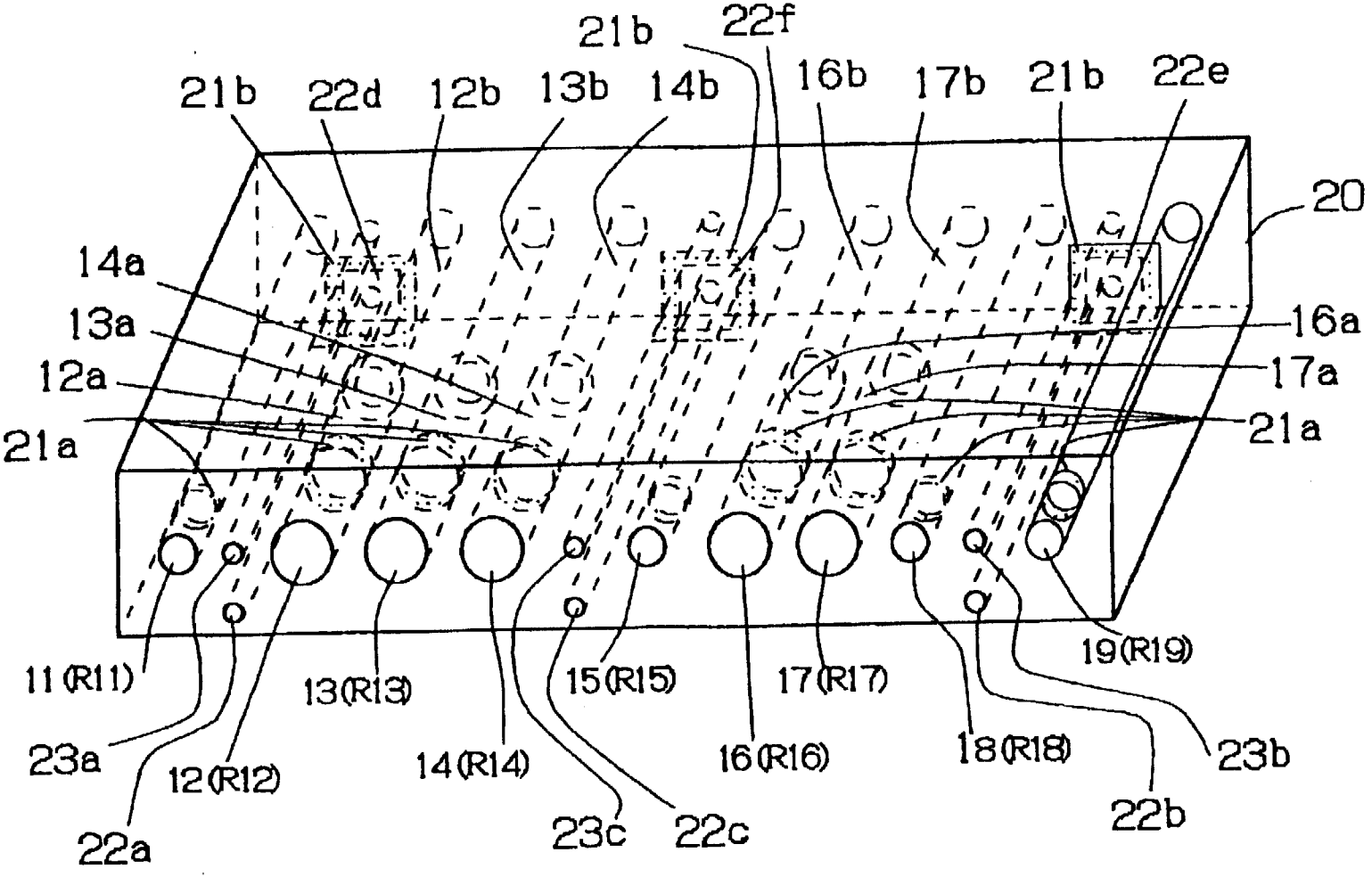
FIG. 5 is a perspective view showing a first embodiment of an antenna duplexer according to the present invention.

FIG. 5 illustrates a first embodiment of an antenna duplexer according to the present invention. Referring to FIG. 5, an outer surface of a dielectric block 20, except for dielectric bases 21b around the input and output terminals and an antenna terminal, which will be described later, is mainly coated with an external conductor. Resonators R11 to R19 are formed between a pair of opposing end faces of the dielectric block 20 by resonator holes 11 to 19 each having the same axial length and having an internal coating forming an internal conductor. The resonator holes 11, 15, 18 and 19 are formed straight. The resonator holes 12, 13 and 14 are formed with steps which define coaxial large diameter resonator holes 12a, 13a and 14a and small diameter resonator holes 12b, 13b and 14b. The resonator holes 16 and 17 are formed with steps which define non-coaxial large diameter resonator holes 16a and 17a and small diameter resonator holes 16b and 17b.

In the vicinity of the openings of the large diameter resonator holes at one end face (the open-circuit end face) of the dielectric block 20, open ends of the resonators are formed by ring-shaped dielectric bases 21a. The length of each of the resonators R11 to R19 is defined from the other end face (the short-circuit end face) to the dielectric bases 21a. Therefore, since resonant frequencies of the resonators R11 to R19 are determined by the lengths of the resonators, they are determined individually by the positions of the dielectric bases 21a.

In the resonators R12 to R14 and R16 to R17, the large diameter resonator holes 12a to 14a and 16a to 17a are formed coaxially or non-coaxially and have steps, and the small diameter resonator holes 12b to 14b and 16b to 17b are at the short-circuit end, in order to strengthen the capacitive coupling between the resonators adjacent to each other.

At a position which is between the resonator holes 11 and 12 but which is closer to the bottom of the dielectric block 20 than to the resonator holes 11 and 12, an input external coupling bore 22a is formed in parallel with the resonator holes 11 and 12. An internal conductor of the external coupling bore 22a is connected to an external conductor at one end face of the dielectric block 20, in this example the open-circuit end face, and is connected to an input terminal 22d which is isolated from the external conductor by the dielectric base 21b at the other end face of the dielectric block 20. The input external coupling bore 22a receives input signals and transmits them by electromagnetic coupling with the resonators R11 and R12. The outside resonator R11 serves as a trap resonator.

In addition, at a position which is between the resonator holes 18 and 19 but which is closer to the bottom of the dielectric block 20 than to the resonator holes 18 and 19, an output external coupling bore 22b is formed in parallel with the resonator holes 18 and 19. An internal conductor of the output external coupling bore 22b is connected to an external conductor at one end face of the dielectric block 20, in this example the open-circuit end face, and is connected to an input terminal 22e which is isolated from the external conductor by the dielectric base 21b at the other end face of the dielectric block 20. The output external coupling bore 22b receives output signals by electromagnetic coupling with the resonators R18 and R19. The outside resonator R19 serves as a trap resonator.

Further, at a position which is between the resonator holes 14 and 15 but which is closer to the bottom of the dielectric block 20 than to the resonator holes 14 and 15, an antenna external coupling bore 22c is formed in parallel with the resonator holes 14 and 15. An internal conductor of the antenna external coupling bore 22c is connected to an external conductor at one end face of the dielectric block 20, in this example the open-circuit end face, and is connected to an antenna terminal 22f which is isolated from the external conductor by the dielectric base 21b at the other end face of the dielectric block 20. The antenna external coupling bore 22c receives and transmits antenna inputs and outputs by electromagnetic coupling with the resonators R14 and R15.

On the other hand, above the input external coupling bore 22a, output external coupling bore 22b and antenna external coupling bore 22c, there are formed an input external coupling adjustment bore 23a, an output external coupling adjustment bore 23b and an antenna external coupling adjustment bore 23c, respectively, each having an internal conductor formed therein. These external coupling adjustment bores 23a, 23b and 23c have the function of adjusting the degree of the electromagnetic coupling between the external coupling bores 22a, 22b and 22c and the corresponding resonators.

The resonators R11 to R14 constitute a transmitting filter, and the resonators R15 to R19 constitute a receiving filter.

In this embodiment, the resonators R11 to R19 are formed in the dielectric block 20 in such a manner that axial lengths of the resonator holes thereof are equal. The actual lengths of the resonators are determined by the positions of the dielectric bases 21a formed in the resonator holes.

Figure 6:
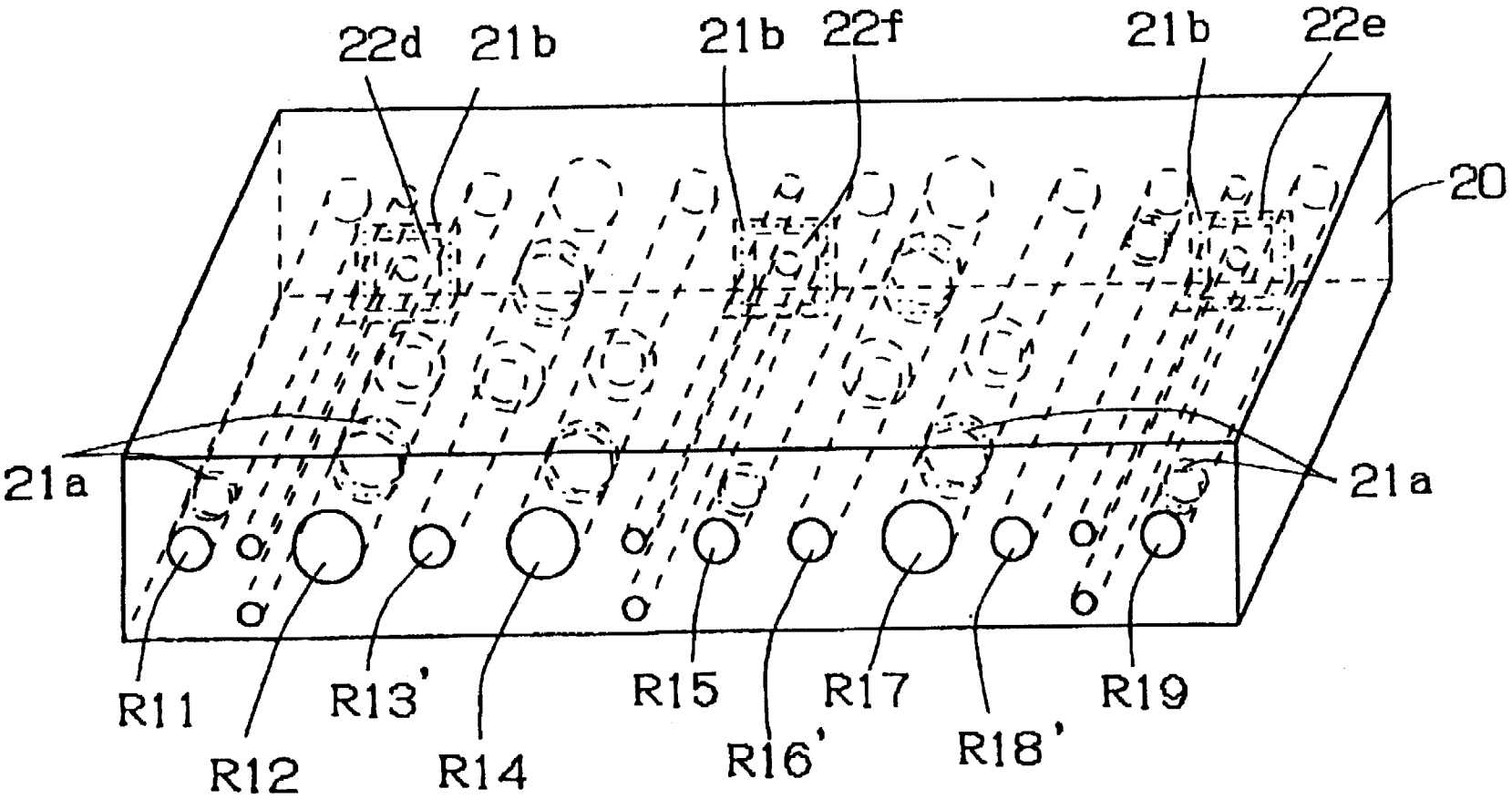
FIG. 6 is a perspective view showing a second embodiment of an antenna duplexer according to the present invention.

FIG. 6 illustrates a second embodiment of an antenna duplexer according to the present invention. Referring to FIG. 6, the resonators R13, R16 and R18 in the first embodiment shown in FIG. 1 are turned by 180 degrees and disposed at the same positions. They are called R13', R16' and R18' in this embodiment, and are interdigitally-coupled. Since the structure of the antenna duplexer of this embodiment is similar to that of shown in FIG. 5, except for the resonators R13', R16' and R18', the same components are indicated by the same references and an explanation thereof has been omitted.

Although the antenna duplexer of this embodiment includes transmitting and receiving filters of different frequencies as in the case of the first embodiment, the dielectric block can be formed into a simple rectangular shape.

Figure 7:
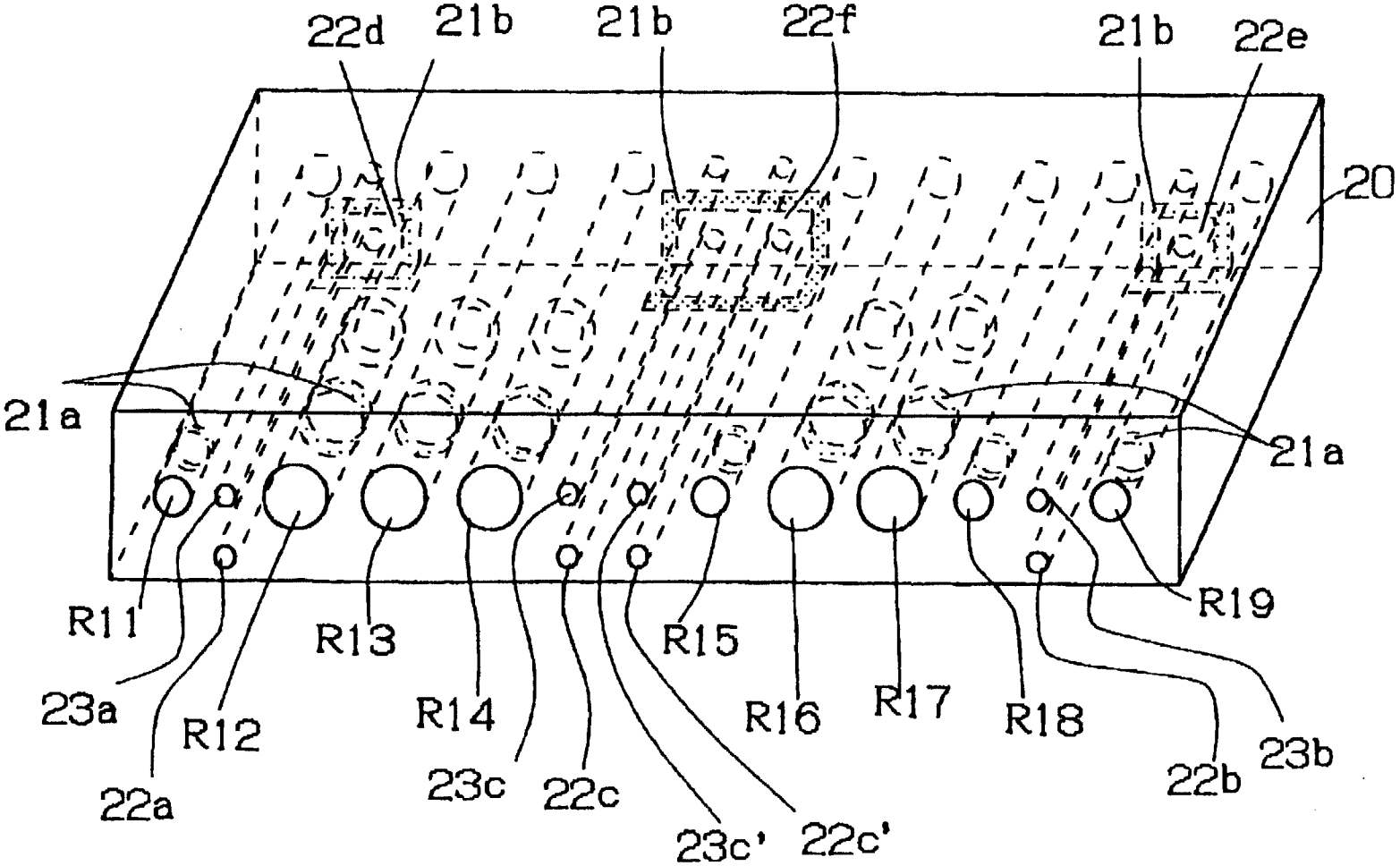
FIG. 7 is a perspective view showing a third embodiment of an antenna duplexer according to the present invention.
Figure 8:
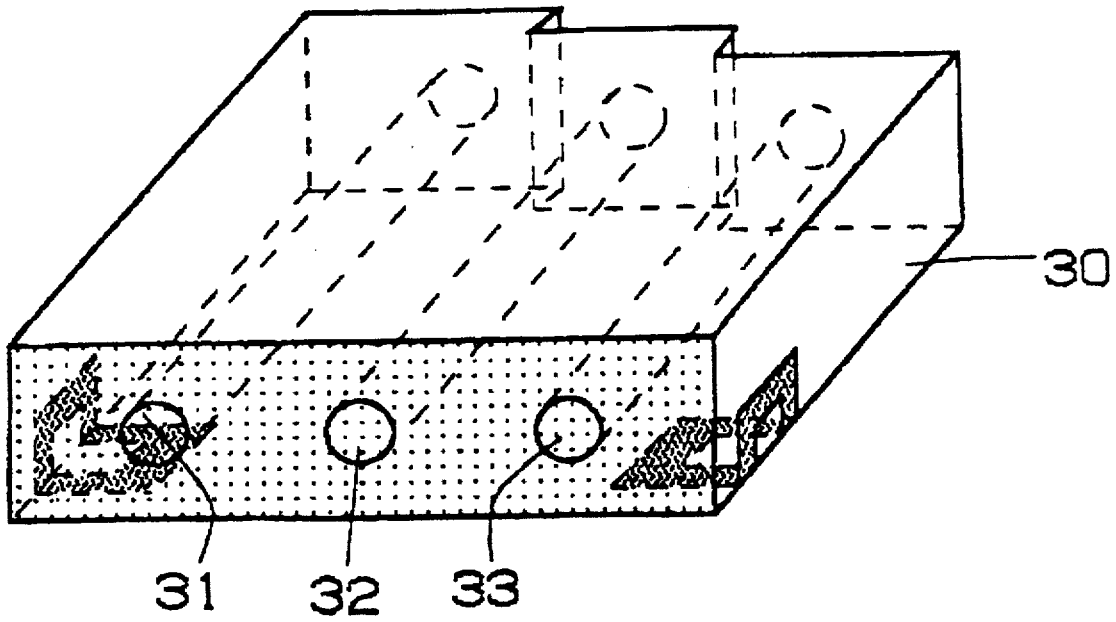
FIG. 8 PRIOR ART
FIG. 8 is a perspective view of a conventional dielectric filter.

FIG. 7 illustrates a third embodiment of an antenna duplexer according to the present invention. Referring to FIG. 7, an additional set of bores, like the antenna external coupling bore 22c and the antenna external coupling adjustment bore 23c in the first embodiment shown in FIG. 5, are provided. In this embodiment, they are called the antenna external coupling bore 22c' and the antenna external coupling adjustment bore 23c'. The antenna external coupling bores 22c and 22c' are connected to the same antenna terminal 22f. The antenna external coupling bore 22c and the external coupling adjustment bore 23c are associated with the transmitting filter, while the antenna external coupling bore 22c' and the external coupling adjustment bore 23c' are associated with the receiving filter. Since the structure of the antenna duplexer of this embodiment is similar to that of shown in FIG. 5, except for the antenna external coupling bore 22c' and the antenna external coupling adjustment bore 23c', the same components are indicated by the same references and an explanation thereof has been omitted.

According to this embodiment, since separate antenna external coupling bores and external coupling adjustment bores are formed for transmitting and receiving, the external coupling between the transmitting filter and the antenna, and the external coupling between the receiving filter and the antenna, can be controlled individually, whereby the antenna duplexer can be designed more easily.

According to each of the above-described embodiments, the resonant frequency of an individual resonator can be increased/decreased by shortening/lengthening it.

According to the present invention, a plurality of resonators of different resonant frequencies, or resonant wavelengths, are formed in one dielectric block by resonator holes of the same axial length so that the actual lengths of the resonators are determined by the positions of the dielectric bases formed in the resonator holes. Therefore, a plurality of resonators of different frequencies (resonant wavelengths) can be formed in one rectangular-shaped dielectric block in such a manner that the length of the resonators is fixed, thereby ensuring a reduction in manufacturing costs.

What is claimed is:

1. A dielectric filter, comprising:

a dielectric block; an input terminal and an output terminal thereon; an external conductor formed on an outer surface of the dielectric block except for areas surrounding the input and output terminals;

a plurality of resonator holes of the same axial length;

input and output external coupling bores, said resonator holes and said input and output external coupling bores being formed substantially in parallel with each other between a pair of opposing end faces of said dielectric block;

said resonator holes having internal conductors on inner surfaces thereof except for dielectric bases in the vicinity of openings thereof, and said internal conductors being connected to said external conductor at said pair of end faces so that resonators having specific resonator lengths are constituted by the positions of open ends of said resonators formed by said dielectric bases; and said input and output external coupling bores having internal conductors, said internal conductors being connected to said external conductor at one end face of said dielectric block and being connected to said input and output terminals at the other end face of said dielectric block.

2. A dielectric filter as claimed in claim 1, wherein said input and output external coupling bores are closer to a principal side surface of said dielectric block than to said resonator holes.

3. An antenna duplexer, comprising:

a dielectric block; an input terminal, an output terminal, and an antenna terminal thereon; an external conductor formed on an outer surface thereof except for areas surrounding the input and output terminals and the antenna terminal;

a plurality of transmitting and receiving resonator holes of the same axial length;

input and output external coupling bores and an antenna external coupling bore, said resonator holes, said input and output external coupling bores and said antenna external coupling bore being formed substantially in parallel with one another between a pair of opposing end faces of said dielectric block, said output and input external coupling bores being disposed respectively between said transmitting and receiving resonator holes and said outer surface of said dielectric block, and said antenna external coupling bore being disposed between said transmitting and receiving resonator holes;

said transmitting and receiving resonator holes having internal conductors on inner surfaces thereof except for dielectric bases in the vicinity of openings thereof, and said internal conductors being connected to said external conductor at said pair of end faces so that resonators having specific resonator lengths are constituted by the positions of open ends of said resonators formed by said dielectric bases; and said input and output external coupling bores and antenna external coupling bore having internal conductors, said internal conductors being connected to said external conductor at one end face of said dielectric block, and being connected to said input and output terminals and to said antenna terminal at the other end face of said dielectric block.

4. An antennal duplexer as claimed in claim 3, wherein said input and output external coupling bores and said antenna external coupling bore are closer to a principal side surface of said dielectric block than to said resonator holes.

* * * * *